United States Patent [19]

McLoughlin et al.

[11] 4,011,950

[45] Mar. 15, 1977

[54] CIGARETTE MONITORING APPARATUS

[75] Inventors: Robert W. McLoughlin, Belfast; Colin P. Nuttall, Bangor, both of Northern Ireland

[73] Assignee: Gallaher Limited, Belfast, Northern Ireland

[22] Filed: Sept. 19, 1975

[21] Appl. No.: 614,790

[30] Foreign Application Priority Data

Sept. 23, 1974 United Kingdom ..... 41326/74

[52] U.S. Cl. ..... 209/73; 209/82; 209/111.7 R; 250/223 R; 250/209

[51] Int. Cl.[2] ..... B07C 5/344

[58] Field of Search ..... 209/111.7, 82, 73; 250/223 R, 208, 209, 578

[56] References Cited

UNITED STATES PATENTS

| | | | |
|---|---|---|---|
| 3,227,037 | 1/1966 | Park et al. | 209/111.7 X |
| 3,368,671 | 2/1968 | Kaeding | 209/111.7 X |
| 3,455,444 | 7/1969 | Simmons | 209/111.7 X |
| 3,525,433 | 8/1970 | Babb | 209/111.7 X |
| 3,729,636 | 4/1973 | Merker | 250/223 R |
| 3,818,223 | 6/1974 | Gibson et al. | 250/223 |

*Primary Examiner*—Allen N. Knowles
*Attorney, Agent, or Firm*—Andrus, Sceales, Starke & Sawall

[57] ABSTRACT

The invention relates to an apparatus for monitoring the assembly of filter tipped cigarettes. After assembly a succession of the cigarettes are advanced transversely to their length through an optical device in which at least two beams of light are transmitted across the plane of movement of the cigarettes between respective transmitters and photosensitive elements. Each beam is interrupted by each cigarette for a time depending upon the effective transverse dimension of the cigarette as seen by that beam and corresponding pulses from the photosensitive elements are summed and integrated. The output of the integrator is sampled to determine if its value lies within a predetermined range and a fault pulse for rejecting cigarette is produced if the value lies outside the predetermined range.

9 Claims, 6 Drawing Figures

CIGARETTE MONITORING APPARATUS

BACKGROUND OF THE INVENTION

The conventional manner of assembling filter tipped cigarettes involves wrapping and sticking a paper sleeve, which usually simulates cork, around a filter plug which abuts the end of a cigarette rod length so that the sleeve surrounds the plug and overlaps the cigarette rod length. Usually a filter plug of double unit length is interposed between two cigarette rod lengths and a sleeve of double length is wrapped around the double length filter plug overlapping the ends of both cigarette rod lengths. The resulting pair of cigarettes are subsequently separated by cutting the filter plug in half by means of a transverse guillotine cut.

Traditionally, defective cigarettes, for example cigarettes in which the filter plug assembly has perhaps resulted in a wrinkled sleeve or a so-called "flag" formed by a corner of a sleeve which has not been properly stuck down, have been recognised and removed by an operator watching the output of the machine. It is desirable that the monitoring should be carried out automatically, particularly with modern high speed cigarette making machines of which the output is so great that a single operator may not be able to monitor the output effectively. Attempts have been made to detect assembly faults automatically by measuring the pressure drop through the tobacco wrapper, but this is not entirely satisfactory, particularly with certain grades of cigarette paper.

SUMMARY OF THE INVENTION

In accordance with the present invention, apparatus for monitoring the assembly of filter tipped cigarettes comprises means which, in use, continually advances a succession of the assembled cigarettes transversely to their length through an optical device in which, in use, at least two beams of light (which term includes infra red radiation) are transmitted across the plane of movement of the cigarettes between respective transmitters and photosensitive elements and at different angular orientations relatively to the direction of advancement of the cigarettes whereby each beam is interrupted by each cigarette for a time depending upon the effective transverse dimension of the cigarette as seen by that beam, and means connected to the photosensitive elements for responding to a defective cigarette if the time during which that cigarette has interrupted the light beams falling on the photosensitive elements is outside an acceptable range.

With this technique, although the transverse width of the cigarette in the plane of movement cannot be "seen", the use of a number of beams set at an angle to one another enables the majority of the circumference of each cigarette to be monitored. For example, if the optical device includes three transmitters and three respective photosensitive elements, the corresponding light beams are preferably transmitted across the plane of movement of the cigarette along paths which lie one substantially perpendicularly to the plane and the other two sloping in opposite directions at less than 40°, and preferably at 35° to the plane. With this configuration it is unlikely that any appreciable flag or other assembly fault would pass without detection.

Each photosensitive element is preferably arranged to produce a pulse corresponding to the time in which the respective beam is obstructed by a cigarette. The pulses from all the photosensitive elements corresponding to a passing cigarette are then summed and integrated and the output of the integrator is sampled to determine if its value lies within the predetermined range, and a fault pulse is produced if the value lies outside the predetermined range. The fault pulse may then be stored in a memory and subsequently used to activate a rejector which removes the corresponding cigarette from the advancing succession of cigarettes.

The summation of the pulses helps to prevent a slight ovality of a cigarette, which is acceptable, from appearing as a fault as the lengthening of one pulse produced by a longer diameter will be compensated by a shorter pulse produced by a shorter diameter.

In a modification of the optical device, two further light beams are, in use, transmitted between respective further transmitters and further photosensitive elements parallel to the plane of movement substantially perpendicularly to the direction of movement of the cigarettes, one on each side of the plane and at positions so as just not to be interrupted by the advancing succession of properly assembled cigarettes but to be interrupted by a projection from an improperly assembled cigarette, and means connected to the further photosensitive elements for producing a fault pulse if a further light beam has been interrupted.

With this arrangement, if a projection, substantially perpendicular to the plane of movement of the cigarettes, exists, due to a bad assembly, such as a wrinkled sleeve or a projecting flag, the beam will be interrupted momentarily as a cigarette passes. It may then only be necessary to provide two beams crossing the plane of movement sloping in opposite directions at between 55° and 65° to the plane. This is simpler from a constructional point of view than having the beams inclined at less than 40′ to the plane, and is possible as the portion of the cigarette facing perpendicularly to the plane will be effectively monitored by the further beams.

In practice the cigarettes may be advanced through the optical device by an endless conveyor composed of U-shaped cradles each of which is arranged to support at laterally spaced positions a pair of cigarettes joined across an integral double length filter plug, there being two laterally spaced optical devices for separately monitoring the sleeve overlap at a respective end of the double length filter plug. Alternatively, the means for advancing the cigarettes may comprise a suction drum having at its periphery cradles for holding the cigarettes by suction with the filter tipped ends of the cigarettes projecting from an end of the drum. In this case the cigarettes may be advanced through a slot in an optical housing in which the transmitters and photosensitive elements are mounted.

BRIEF DESCRIPTION OF THE DRAWING

Two examples of apparatus constructed in accordance with the present invention are illustrated in the accompanying drawings in which.

DESCRIPTION OF THE PREFERRED EMBODIMENT

Figure 1:
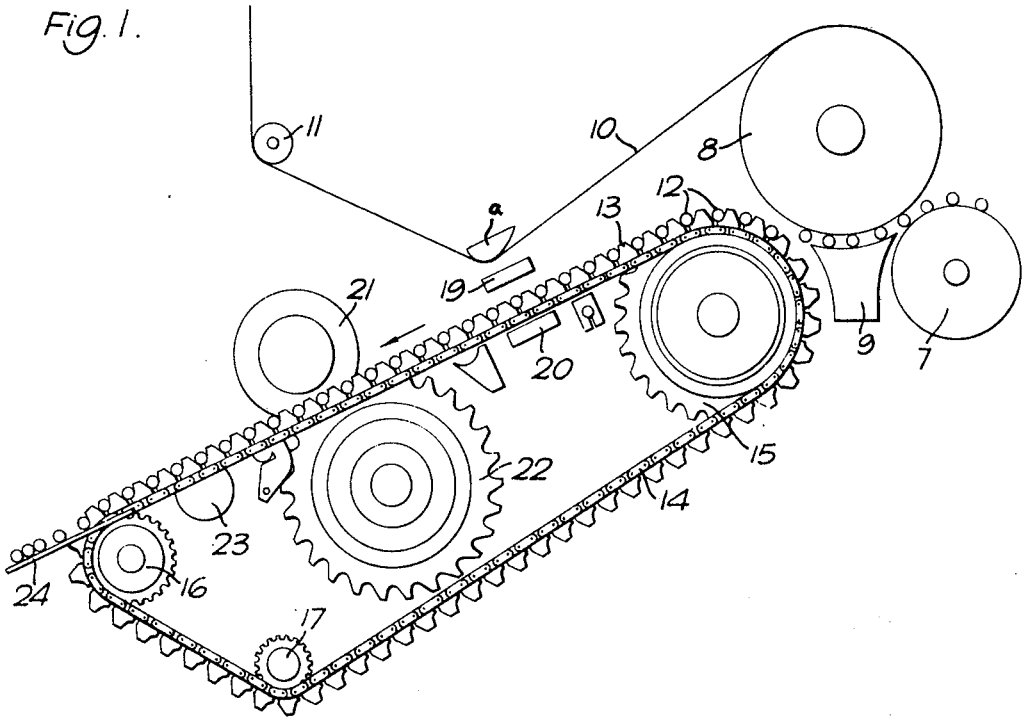
FIG. 1 is a diagrammatic side view of part of a cigarette making machine fitted with the apparatus.

FIG. 1 shows the path of cigarettes through the assembly section of a tipping machine.

Pairs of cigarettes, in axial alignment, with a double length filter plug between them are collated on a deflector drum 7 and the simulated cork sleeve is applied from a cork drum 8. The sleeves are cut from a continuous web 10 which is fed to the drum 8 around a roller 11 and guide *a*. The double length cigarette assembly is rolled between the cork drum 8 and a heated rolling plate 9 and the complete double length assemblies 12 are deposited into laterally spaced U-shaped cradles 13 of an endless conveyor having a pair of endless chains 14 which are driven by sprockets 15, and pass round sprockets 16 and 17.

Figure 2:
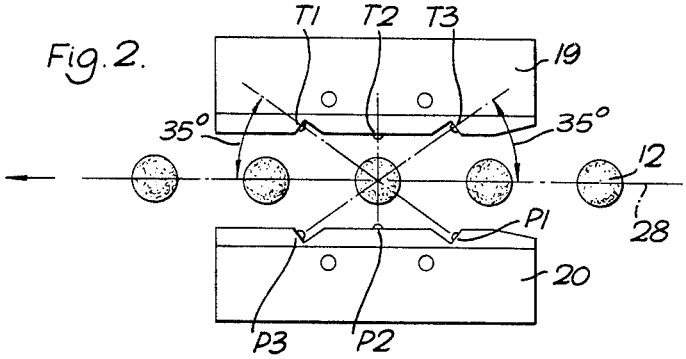
FIG. 2 is a diagrammatic side view of the optical device of the FIG. 1 example, to a larger scale.
Figure 3:
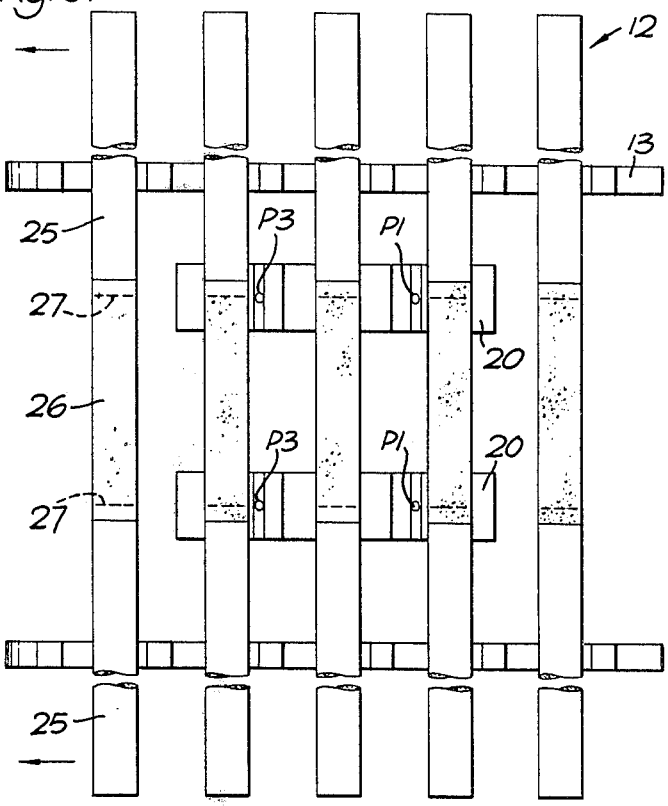
FIG. 3 is a plan of the FIG. 2 optical device.

The cigarette assemblies 12 are thus carried through two optical devices each consisting of an upper block 19 and a lower block 20. One optical device is shown in FIG. 2 and the lower blocks 20 of the two optical devices are visible in FIG. 3. As will be seen from FIG. 3, each cigarette assembly 12 consists of a pair of cigarette rods 25 joined by a double length filter plug surrounded by a wrapping sleeve 26 and the two optical devices are in alignment with the overlap 27 between each end of the sleeve and the corresponding cigarette rod length.

After being inspected by the optical device, the assemblies are slit into two finished cigarettes across the centre line of the double length filter plug by a guillotine 21, which acts against a rotating supporting wheel 22. If the assembly of any one of the cigarettes has proved to be faulty upon inspection by the optical device, that cigarette is automatically rejected and removed from its cradle by a jet of air at a rejector 23, otherwise the finished cigarettes leave their cradles and roll down a surface 24 for packing.

In each block 9 of each optical device there are mounted three light emitting diodes T1, T2 and T3, each provided with an integral lens, and arranged to transmit a beam of light across the plane 28 of advancement of the assemblies 12 onto phototransistors P1, P2 and P3 respectively, which are also provided with integral lenses. Any one of the beams of light could of course be transmitted in the other direction across the plane 28. However, the beam transmitted between the diode T2 and phototransistor P2 is substantially perpendicular to the plane 28 and the beams transmitted between the diodes T1 and T3 and the phototransistors P1 and P3 respectively are inclined at substantially 35° in opposite senses to the plane 28.

As each assembly 12 in turn passes through the optical device, each overlap 27 of each assembly 12 is separately monitored by the corresponding optical device, the three beams of the device being substantially simultaneously interrupted.

Figure 4:
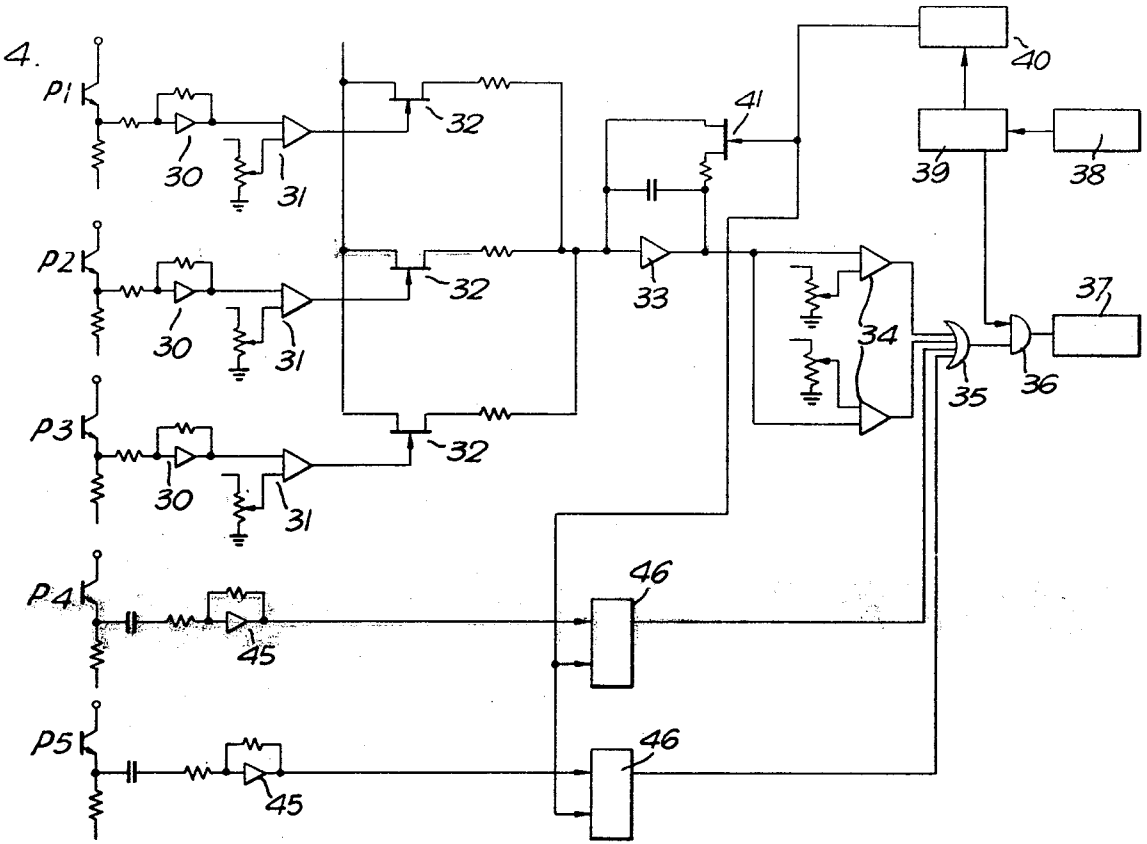
FIG. 4 is an associated electrical circuit.

The signals from the phototransistors P1, P2 and P3 are processed by part of the circuit shown in FIG. 4. Thus the light collected by each phototransistor is converted into electrical energy which is amplified in a corresponding amplifier stage 30 and squared up on a pulse shaper 31. The pulse which is produced when the light beam is obstructed is then used to turn on a corresponding gate 32, which emits a voltage into a common integrator 33. The emitted voltage can be a constant voltage or one proportional to the speed of the tipping machine. All the emitted voltages from the three phototransistors are summed and integrated in the integrator 33 the output of which is examined against preset upper and lower limits by a comparator 34. If the output does not fall within a given range a fault signal is produced which is fed into a logical OR gate 35. At the end of each cycle the output of the gate 35 is sampled logically at a gate 36 and if a fault condition exists it is fed into a memory circuit 37 which operates the rejector 23 when the corresponding cigarette has reached that position.

A timing circuit 38, which operates in synchronism with the advancing conveyor, feeds an end of cycle pulse into a monostable circuit 39 which in turn provides a short sample pulse to the gate 36 and triggers a monostable circuit 40 after the sample pulse. The circuit 40 drives a reset circuit 41 for the integrator for recommencing the cycle.

Figure 5:
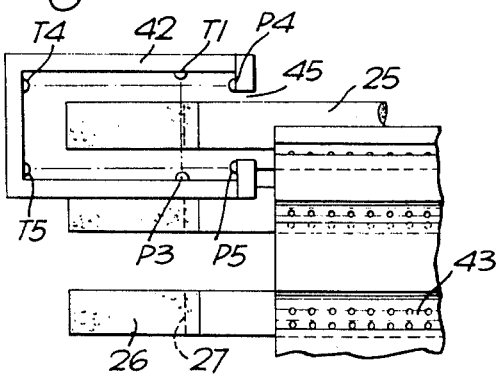
FIG. 5 is a diagrammatic front elevation of part of a second apparatus.
Figure 6:
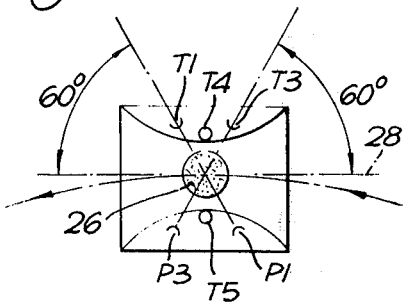
FIG. 6 is a diagrammatic end view of the second apparatus.

In the modification illustrated in FIGS. 5 and 6, the double cigarette assemblies are precut into single cigarettes before the sleeve assembly is inspected. Instead of being advanced by an endless chain conveyor, the individual cigarettes are advanced through an optical device 42 supported by suction in individual cradles 43 in a rotating suction drum 44. The filter tipped end of each cigarette passes in turn through a slot 45 in the housing of the optical device where it intercepts two beams of light transmitted between diodes T1 and T3 and respective phototransistors P1 and P3, similar to the diodes and phototransistors T1, T3, P1, and P3 in the first example. In this case the beams cross the plane 28 of advancement of the cigarettes in opposite inclinations at angles of approximately 60° to the plane.

The parts of the cigarette facing perpendicularly to the plane 28 are monitored by two further light beams, one on each side of the plane, transmitted between further light emitting diodes T4 and T5 and respective phototransistors P4 and P5. Properly assembled cigarettes are clear of these two further light beams but a projection perpendicular to the plane 28 resulting from faulty assembly of a cigarette, will cause one of the further light beams to be interrupted.

In the second example the signals from the phototransistors P1 and P3 are summed and integrated as shown in FIG. 4 and in the event of an incorrect assembly being detected by the corresponding two light beams, a corresponding fault pulse is stored in the memory circuit 37 and subsequently operates a conventional rejector at a later position in the cigarette production line. In the event of one or other of the further light beams being interrupted, a fault signal is immediately sent to the one of two flip-flop circuits 46 via an A.C. coupled signal amplifier 45. The output of each flip-flop 46 is fed to the logical OR gate 35 and a fault pulse transferred to the memory 37 via gate 36 when monostable circuit 39 produces the sample pulse at the end of the cycle. The flip-flops 46 are reset by the same pulse, from monostable circuit 40, which resets the integrator 33.

We claim:

1. Apparatus for monitoring the assembly of filter tipped cigarettes, said apparatus comprising: means for continuously advancing a succession of assembled cigarettes transversely to their length through an optical device; said optical device including at least two transmitters for transmitting beams of light across the plane of movement of the cigarettes at different angular orientations relative to the movement plane, each beam being interrupted by each advancing cigarette for a time depending on the effective transverse dimension of the cigarette as seen by that beam, and photosensitive elements for receiving the beams of light from said transmitters and for providing a signal corresponding to the time during which the respective beam of light is interrupted; and signal combining means coupled to said photosensitive elements and responsive to the combined magnitude of the signals of said photosensitive elements for responding to a defective cigarette if the combined magnitude of said signals is outside a predetermined range.

2. Apparatus according to claim 1, in which each of said photosensitive elements is associated with means for producing a pulse corresponding to said time in which the respective one of said beams is obstructed by a cigarette, and said signal combining means further comprises means for summing and integrating said pulses corresponding to a single cigarette, and means for sampling the output of said integrator to determine if its value lies within a predetermined range and for producing a fault pulse if said value lies outside said predetermined range.

3. Apparatus according to claim 2, further comprising a rejector adapted to respond to said fault pulse to remove the corresponding cigarette from said advancing succession of cigarettes.

4. Apparatus according to claim 1, wherein said optical device includes three of said transmitters and three respective ones of said photosensitive elements, said three transmitters being adapted to transmit said light beams across said plane of movement of said cigarettes along paths which lie one substantially perpendicularly to said plane and the other two sloping in opposite directions at less than 40° to said plane.

5. Apparatus according to claim 1, wherein said means for advancing said cigarettes comprises an endless conveyor composed of U-shaped cradles each of which is adapted to support at laterally spaced positions a pair of cigarettes joined across an integral double length filter plug, there being two laterally spaced ones of said optical devices for separately monitoring the sleeve overlap at a respective end of said double length filter plug.

6. Apparatus according to claim 1, in which said optical device includes two further transmitters adapted to transmit two further light beams parallel to said plane of movement substantially perpendicular to the direction of movement of said cigarettes, one on each side of said plane, and at positions adapted just to not to be interrupted by said advancing succession of properly assembled cigarettes but to be interrupted by a projection from an improperly assembled cigarette, two further photosensitive elements adapted to receive said respective further light beams, and means connected to said further photosensitive elements for producing a defective cigarette response if one of said further light beams has been interrupted.

7. Apparatus according to claim 6 further comprising a rejector coupled to said signal combining means and said further photosensitive elements to remove said corresponding cigarette from said advancing succession of cigarettes.

8. Apparatus according to claim 1, wherein said means for advancing said cigarettes comprises a suction drum having at its periphery cradles for holding said cigarettes by suction with the filter tipped ends of said cigarettes projecting from an end of said drum.

9. Apparatus according to claim 8, wherein said optical device incorporates a slotted housing in which said transmitters and said photosensitive elements are mounted, said drum being adapted to advance said cigarettes in succession through a slot in said housing.

* * * * *